US006245388B1

(12) United States Patent
Foster et al.

(10) Patent No.: US 6,245,388 B1
(45) **Date of Patent: *Jun. 12, 2001**

(54) WAVE COATING OF ARTICLES

(75) Inventors: Peter D. Foster, Oakland, MA (US); John Allie Charny, Richmond Heights, OH (US)

(73) Assignee: The Chinet Company Technology, Waterville, ME (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/343,618

(22) Filed: Jun. 30, 1999

(51) Int. Cl.[7] ..... B05D 3/04

(52) U.S. Cl. ..... 427/345; 427/235; 427/236; 427/348; 427/424; 427/434.3; 427/439; 118/DIG. 3

(58) Field of Search ..... 427/235, 236, 427/348, 345, 424, 434.3, 439; 118/DIG. 3, DIG. 8, 602, 314, 317

(56) References Cited

U.S. PATENT DOCUMENTS

| | | | | |
|---|---|---|---|---|
| 1,266,669 | * | 5/1918 | Eberhart . | |
| 2,899,299 | | 6/1959 | Ritson . | |
| 3,297,615 | | 1/1967 | Frazier et al. . | |
| 3,365,410 | | 1/1968 | Wesslau et al. . | |
| 3,401,863 | | 9/1968 | Earl . | |
| 3,935,041 | * | 1/1976 | Goffredo et al. | 427/424 |
| 4,421,825 | | 12/1983 | Seiter . | |
| 4,463,029 | | 7/1984 | Nishijima et al. . | |
| 4,595,611 | | 6/1986 | Quick et al. . | |
| 5,088,640 | | 2/1992 | Littlejohn . | |
| 5,326,017 | | 7/1994 | Liu et al. . | |
| 5,418,008 | | 5/1995 | Calvert . | |
| 5,494,716 | | 2/1996 | Seung et al. . | |
| 5,545,440 | * | 8/1996 | Thornberg | 427/345 |
| 5,545,450 | | 8/1996 | Andersen et al. . | |
| 5,573,693 | | 11/1996 | Lorence et al. . | |
| 5,587,206 | | 12/1996 | Paul et al. . | |
| 5,855,973 | | 1/1999 | Calvert et al. . | |
| 5,868,307 | | 2/1999 | Calvert . | |

FOREIGN PATENT DOCUMENTS

| | | |
|---|---|---|
| 2057474 | 2/1993 | (CA) . |
| 37 20 265 | 12/1988 | (DE) . |
| 311415 | 5/1930 | (GB) . |
| 1111525 | 5/1968 | (GB) . |
| 2 239 443 | 7/1991 | (GB) . |
| WO 88/10337 | 12/1988 | (WO) . |

OTHER PUBLICATIONS

BF Goodrich, "Latxes for Paper Treatment" (1982) (no month date).

Customer Service Report "Water Vapor Barrier Properties of a Food Grade Paper Coating", E.R. Urig, Mar. 17, 1982.

"Thermal Analytical Characterization of Polymer Coated Paper", Nikora et al (undated).

* cited by examiner

*Primary Examiner*—Katherine A. Bareford
(74) *Attorney, Agent, or Firm*—Connolly Bove Lodge & Hutz LLP

(57) ABSTRACT

A process and an apparatus are disclosed for coating at least one surface of an article such as a paper plate with a liquid coating. The surface to be coated is passed through a wave of liquid coating, such as an aqueous dispersion, followed by removal of the excess coating. The coating and coating removal steps are carried out in an environment which is vaporous with the vehicle of the liquid coating, which prevents premature drying of the coating and allows for a smooth, even application of the coating to the surface.

19 Claims, 2 Drawing Sheets

WAVE COATING OF ARTICLES

BACKGROUND

The invention relates to a process, and to apparatus, for applying a liquid coating to at least one surface of an article. The process produces a high quality, attractive and uniform coating on both flat and contoured surfaces, while minimizing waste of the liquid coating. Preferred articles to be coated using the process are paper plates, cartons, bowls, serving dishes, trays, or similar articles made of molded pulp, pressed or folded paperboard, and the like. While these articles are preferred, essentially any type of article may be coated using the disclosed process and apparatus.

Some manufactured articles can be improved by application of a coating on at least one surface of the article. For example, molded pulp articles used for serving food, such as molded pulp plates and bowls, are light-weight, disposable and low cost. In use, however, these articles can lose their form and/or function in the presence of heat, moisture and/or grease (for example, as in the case of a paper plate weakening when hot, wet food is held in the plate). A protective barrier on a molded pulp or paper article can prevent loss of strength or rigidity due to such factors, which improves the performance of the article in immediate use, and in applications where food is held with or without refrigeration in the article for a period of time, and possibly heated, prior to consumption. Other reasons for coating an article include providing additional surface strength, improving cut resistance, or adding to the aesthetic appearance of the article. For example, one may add color, patterns, textures and sheen to the surface of the article. One may also coat an article to protect an underlying print or to improve its printability.

It is known to pre-apply a wax or polymer coat on the food-contact surface of paperboard, and to thereafter form the paperboard into useful food-service articles. There are problems, however, when attempting to apply coatings to preformed, contoured molded pulp articles rather than to flat paperboard.

GB 1,111,525 (published May 1, 1968) describes some disadvantages of prior art efforts to coat articles, particularly articles with deep contours. For example, dipping an entire article in liquid coating can saturate the article and apply too much coating to the article. Furthermore, it is impractical to dip only the inside (food-contacting) surface of a deeply contoured article into a liquid coating material.

It is also known to spray paper and molded pulp articles with liquid coating materials. See, for example, Canadian Patent Application 2,057,474. Aqueous dispersions or latexes of various plastics, such as acrylic, vinyl and styrene-butadiene, have been sold for many years for use in coating molded pulp articles. Spraying a contoured article with liquid coating, however, can produce uneven coatings, despite the exercise of care in the spray application. Moreover, spray-coating methods used in the prior art generally do not make efficient use of the coating material. Overall, the prior art of coating articles with a protective barrier layer leaves room for improvement.

SUMMARY OF THE INVENTION

The present invention relates to processes, and apparatus, for applying liquid coatings to a surface (or to more than one surface or edge) of an article.

In a first embodiment, the process comprises passing the surface of an article to be coated above an upwardly-directed wave of liquid coating to apply the coating to the surface in excess. Preferably, the wave of coating is applied by one or more upwardly pointed nozzles, which nozzles direct the wave(s) of coating onto the articles to be coated as the articles are passed above the nozzles and through the wave of coating. For example, the articles may be positioned on moving conveyer belt which passes the articles through the wave coating(s), exposing the surface of the articles to be coated to an excess of the coating. After coating the surface of the article, the excess coating is then removed and the coated article is dried.

In a preferred aspect, the wave coating of the article and the removal of excess coating, as described above, are carried out in an atmosphere which is vaporous with the liquid coating vehicle. This can be accomplished by carrying out the coating application and coating removal steps in a closed environment. Inside the closed environment, the water (or other coating solvent) which comprises the vehicle of the liquid coating is caused to permeate the coating atmosphere, to make the closed environment vaporous with the vapor of the coating vehicle. The is preferred coatings are aqueous dispersions, and using these coatings, the closed atmosphere is vaporous with water vapor. Maintenance of a vaporous atmosphere during coating and removal of excess coating has been found to considerably, and surprisingly, enhance the quality of the coating, for example in terms of evenness, lack of streaking and other desirable coating qualities.

It has also been found that, when using a vaporous, closed environment for the application of liquid coating and coating removal steps of the process, it is possible to apply the liquid coating other than by wave-coating. Thus, in a different embodiment of the invention, an excess of liquid coating is applied to a surface of an article, and thereafter the excess coating is removed, wherein the aforesaid coating application and coating removal steps are carried out in a closed environment which is vaporous with the vehicle of the liquid coating. In the vaporous environment of the closed atmosphere, any type of coating application means may be used to apply the liquid coating (which in this embodiment is also preferably an aqueous dispersion) while still obtaining t desired high quality, attractive coatings.

In both embodiments of the process as described above, the excess coating is preferably recovered and reused in the coating process. In a vaporous, closed environment as described, it is possible to apply the coating, remove the excess coating, and reuse the coating, without substantial drying of the coating. This allows for significantly more efficient use and reuse of the liquid coating.

The apparatus of the invention comprises means for applying a wave of liquid coating to a surface of an article, means for removing the excess of liquid coating from the coated surface, means for recovering excess coating for reuse, and means for maintaining a closed environment, which is vaporous with the coating vehicle, during the coating application, coating removal and coating recovery.

BRIEF DESCRIPTION OF THE DRAWING FIGURES

DESCRIPTION OF THE PREFERRED EMBODIMENTS

The present invention provides a method for applying a liquid coating to at least one surface of an article to achieve a uniform, high quality coating. While essentially any size or shape of article may be coated using this process, the present invention finds particular applicability to coating molded pulp articles for packaging and/or serving food, such as trays, plates, dishes and bowls. The use of molded pulp paper plates, and the coating of a single food-contacting surface of the paper plates, will be described as exemplary in the discussion which follows. It will be understood that more than one surface of an article can be coated using this process, for example by repeated passes through the system.

The process of the invention using wave application of coating allows for minimizing the amount of liquid coating which is used to form the coating, without detracting from the quality of the coating. At the same, the surfaces are coated at a fast and efficient rate, and are provided with a uniform coating on uneven or contoured surfaces of the article. Any of a variety of shapes can be coated.

Figure 1:
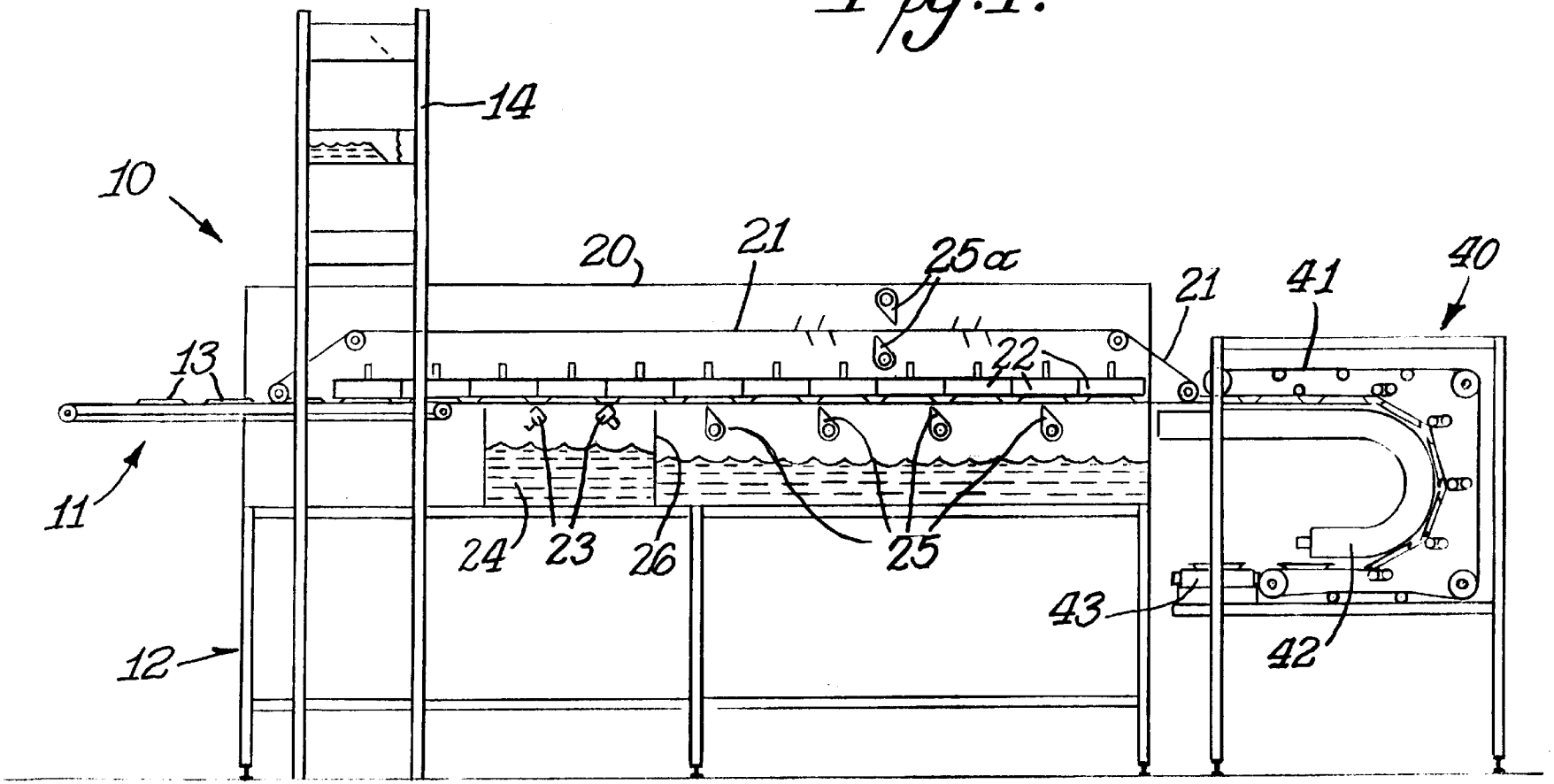
FIG. 1 illustrates a side schematic view of a currently-preferred type of apparatus for carrying out the process of the invention.
Figure 2:
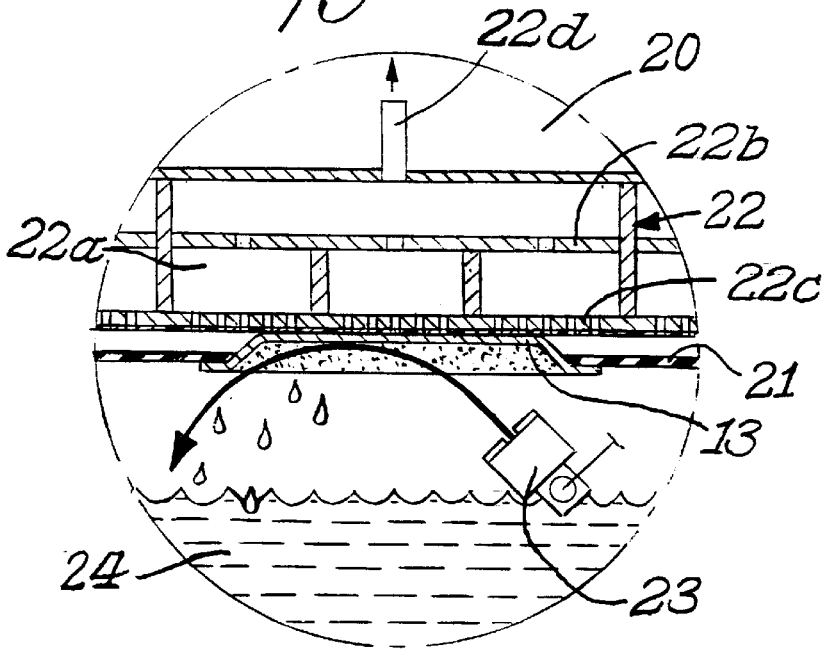
FIG. 2 is a magnified view of the coating area of the embodiment of FIG. 1, wherein an inverted molded pulp paper plate is being passed through a wave of liquid coating.

To describe the general operation of the process, reference is made to FIGS. 1 and 2. As shown, inverted paper plates are passed into contact with at least one wave of liquid coating which is applied from below the articles. The speed of the passing articles, and the flow volume of the wave of liquid coating, are adjusted such that a great excess of coating (relative to a base amount of coating sufficient to contact the entire surface area of the article with coating) comes into contact with the article surface. In this manner, the entire surface is completely drenched with the liquid coating, including any areas of irregular shape or contour on the surface (such as the ridges between compartments in multi-compartment food trays and paper plates). The application of excess coating ensures a complete and thorough coating over the entire surface. Since coating is collected and reused, the application of excess coating at this stage is not wasteful or inefficient.

As shown in FIGS. 1 and 2, it is preferred to apply the excess of liquid coating in the form of an arc or "wave". As describe below, a wave of liquid coating can be created by applying the coating through a nozzle, with the nozzle directed at an angle relative to the horizontal. The size, shape and angle of the wave can be adjusted to assure sufficient contact between the plate surface and an excess of the liquid coating. As shown in FIG. 2, a wave is essentially an upwardly-directed sheet of liquid.

More than one wave of liquid coating can be directed toward the same surface by different nozzles, in series or simultaneously. When coating contoured molded pulp articles, it is preferred, though not always necessary, to apply more than one wave of coating, and to apply the waves from different directions to the surface. For example, if the plates are passing above the nozzles on a moving conveyer belt, one wave of coating can be directed generally towards the direction of movement of the conveyer belt, while another wave of coating is directed generally against the direction of movement of the conveyer belt. In this manner, the liquid coating fully contacts both the leading edges and trailing edges of a contoured surface with an excess of liquid coating. Depending on the depth and/or contour of the surface of the article, one or more of the nozzles may be placed at an angle up to 90 degrees with respect to the horizontal (the horizontal being defined by the moving conveyer in this embodiment).

The wave(s) of coating are applied by coating application means positioned below the surface to be coated. Coating application means may consist of nozzles situated below the moving paper plates. In a preferred type of nozzle, a wave may be generated by forcing the liquid coating through a slotted orifice. Preferably the nozzle opening (slot) is about 0.03 to 0.125 inches, and the slot should be sufficiently long to provide a wave of coating at least as wide as the plates being coated. As noted, several waves can be provided to contact the plate surface from different directions, and this can be accomplished by positioning multiple nozzles in the path of the moving plates. The angle of the nozzle(s) relative to the passing plates can depend on the rate at which the articles pass through the coating area. The angle of the nozzle can also depend on the surface structure and contour of the surface to be coated. For most uses including coating of compartmented molded pulp paper plates, a nozzle angle of about 45 degrees is appropriate. Using only minimal adjustments, the proper belt speed and nozzle angles needed to apply an excess of liquid coating can be determined.

After the surface has been exposed to wave coating to apply an excess of coating, the excess coating material is removed from the surface of the article. Examples of suitable coating removal means are air knives, brushes, vacuum knives, or combinations of these and like devices. In a currently-preferred manner of operation, the excess liquid coating is removed with high velocity air delivered from slotted air knives. The forced air from the air knives acts to thin and spread the coating over the surface, and to remove the excess coating material.

Means are provided to recover the excess liquid coating removed from the surface. For example, the material removed from the surfaces by the air knives can be collected below the moving plates and delivered to the coating area, for example in collection trays. If necessary, the recycled coating material can be filtered, screened, or stored before being returned to the coating area for reuse. Additional reconditioning of the liquid coating may be carried out before reuse (e.g., replenishing solid or vehicle, adding defoaming agent, further filtering, de-aeration, pH adjustment, temperature adjustment, and the like).

It is important that the application of excess coating and the subsequent removal of excess coating, as described above, are carried out in a closed environment which is vaporous with the vehicle of the liquid coating. While it is possible, though not necessary, that the atmosphere inside the closed environment be totally saturated with the coating vehicle, the atmosphere should be sufficiently vaporous to prevent any significant drying of the coating inside the closed environment. Preferably, conditions inside the closed environment are maintained such that essentially no drying of the liquid coating takes place on the article surface or elsewhere (e.g. on the conveyer belt).

The vaporous environment allows the liquid coating to be fully and evenly spread on the surface of the article, and also aids in recovery and reuse of excess coating solution. It has been found that, if the coating dries to any significant extent before or during the coating removal step, undesired ripples and streaks can occur in the coating.

As noted, a further embodiment contemplates that, in a closed, vaporous environment, the excess coating may be applied other than as a wave. For example, one may apply the coating by spraying, dipping, rolling, padding, painting, liquid streams or the like. In this embodiment as well, the coating is applied in great excess, and the coating application and coating removal steps are preferably carried out in a closed, vaporous environment. In some instances, the coating can be applied just prior to introducing the articles into the closed environment, provided that premature drying is not permitted to occur.

The preferred liquid coatings are aqueous coatings, such as latexes. When using an aqueous coating, the vaporous environment is humid with water vapor. To achieve a smooth, uniform coating, the atmosphere inside the closed environment is kept moist and humid. The level of water vapor in the atmosphere can be easily controlled, for example, by injecting water vapor into the closed environment or by entraining atomized liquid water in the air fed to the closed environment.

It should be understood that, in certain embodiments in which less aesthetic but still functional surface coatings are sufficient (e.g. a rippled surface coating), the wave coating process of the invention can be carried out in a nonvaporous environment. When smooth, even, uniformly thin surface coatings are desired, the process should be carried out in the vaporous environment, as described.

When removal of aqueous coating is accomplished with air knives, the air streams delivered through the air knives can be humid, which contributes to maintenance of a vaporous atmosphere inside the closed environment. Fresh air entering the closed environment can be pre-humidified. The humidified air delivered through the air knives forces excess liquid coating from the surface of the plate and spreads the remainder of the coating without drying the surface of the coating.

After removal of excess coating material, drying of the coated article is subsequently accomplished in a separate step, outside the vaporous atmosphere, by any conventional means such as heating in warm air. Additional means of drying include exposure to infrared, microwave or radio frequency radiation. Different means of drying can be used in combination.

Suitable coating materials, and liquid dispersions or solutions of such materials, are familiar to those in the art. While the invention is not so limited, for reasons of cost, ease of use, and non-toxicity, the liquid coatings are preferably aqueous dispersions. Examples of useful coatings include latexes, dispersions of polymers of ethylene, propylene, butadiene, styrene, vinyl acetate, vinyl chloride, vinylidene chloride, vinyl alcohol, amides, acrylic, polyester, epoxies, epoxy esters, hydrocarbon resins and mixtures or copolymers thereof. Currently, the coating most preferred for coating molded pulp paper plates comprises a styrene-acrylic, styrene-butadiene or ethylene-vinyl acetate aqueous dispersion.

Optional components of the coating include wax, mineral filler or colorants such as clay, titanium dioxide, calcium carbonate, silica, and organic or inorganic acids or bases. Other optional ingredients are natural or derivatized starch, fluorochemicals, silicones, oil repellants, defoamers, wetting agents, color pigments, fillers, thickeners and other additives known in the art. Preferably, the coating material is a water dispersion or emulsion containing about 15–65% total solids. The viscosity of the coating should not be so high as to interfere with the application of the liquid in waves, for example generated through slotted nozzles, as described above. Coatings of this type are available commercially, for example from Michelman, Inc., Cincinnati, Ohio and include Michelman "StainBan" Coatings. The currently most preferred coating for paper plates is an aqueous dispersion of styrene-acrylic polymer, which contains about 30% total solids and contains a pigment ($TiO_2$), an oil repellent, and optionally other processing aids.

Depending on the coating, some coated food containers can be used in conventional or microwave ovens to heat the contents. Liquid coating materials are available which form coatings which can survive a range of temperature from deep freeze temperatures to temperature at which food is heated in a conventional oven, such as −20 to 425 degrees F. Coatings are available which can be used on food containers which are "dual ovenable", that is, the containers are ovenable in either a conventional oven or in a microwave oven. An example of a liquid coating suitable for making an ovenable coating is a mixture of water, sulfonated polyester (e.g., sulfonated polyethylene terephthalate polyester), rutile calcium carbonate, and a cross-linking agent such as hexamethylolmethyl melamine/formaldhyde, which is described in U.S. Pat. No. 4,595,611, issued Jun. 17, 1986. Aqueous, acrylic-based materials suitable for making coatings for dual ovenable containers have been sold for many years by B. F. Goodrich under the name "Hycar".

When coating with an aqueous coating, a paper or pulp article such as a paper plate may be sized with a conventional sizing agent to prevent or reduce water permeation into the article during the coating process.

The methods of the invention, and the apparatus for carrying out the methods, will be further exemplified by detailed reference to the drawing figures, which again show the use of typical, molded pulp paper plates as an exemplary type of article to be coated.

FIG. 1 shows a coating apparatus 10 as used for coating paper plates with liquid coating. The apparatus generally comprises an inlet area 11, where the paper plates 13 are fed into the process, a main chamber defining the closed environment wherein excess liquid coating is applied and removed, and an outlet station 40, where the plates are delivered from the closed environment for further processing (e.g. drying).

Paper plates 13 are loaded at the inlet area 11, either manually or automatically, in an upside-down orientation, and delivered for engagement with conveyer belt 21 which carries the paper plates into the closed environment 20 for coating and coating removal. The conveyor belt 21 can be a pocketed conveyor having a plurality of openings which accommodate the depressed back of the paper plate, while the rim of the plate engages the conveyer belt. See FIG. 2. First subchambers 22 inside the closed environment 20 provide a suction force which holds the plates in the conveyer belt. As seen in FIG. 2, the rim of the plate forms a seal with the conveyer belt, and a tight seal between the plate rim and the conveyer belt keeps coating solution from entering the subchambers as the paper plate is coated. It has been found that a particularly good seal is formed is the conveyer belt is made of foamed material or comprises a foam-like layer in contact with the plate. Thus, the plates are picked up by the conveyer belt, and carried into the closed environment 20, with the surface to be coated facing downwardly.

The first subchambers 22 are shown as a number of separate chambers, and the vacuum pressure in each first subchamber 22 can be independent of that of the other first subchambers 22.

Separate vacuum force can be provided to each subchamber by vacuum connection 22*d* provided on each first subchamber. Thus, when an opening in the conveyer belt does not contain a plate, the vacuum pressure exerted on other plates in the conveyer can be independently maintained.

In a particularly preferred embodiment shown in FIG. 2, each first subchamber 22 contains a number of secondary subchambers 22*a*, defined at the top by a top plate 22*b* and a bottom plate 22*c*. The top plate above each secondary subchamber is provided with an orifice hole, to allow the vacuum from the first subchamber to draw into the second subchamber. Each bottom plate 22*c* is provided with a plurality of smaller (e.g. one quarter inch diameter) holes, to allow the vacuum in the second subchambers to draw the plate 13 against the lowermost face of the bottom plate. Since the plate 13 can contact the bottom plate 22*c* during operation, it has been found to be advantageous to compose the bottom plate of very high molecular weight polyethylene, which has a slipperiness which allows the plates 13 to glide easily over the bottom plate while they are being drawn against it by vacuum.

The closed environment 20 provides an atmosphere which is vaporous with the vehicle of the liquid coating. As shown at 24 there is a reservoir of liquid coating in the closed environment.

Inside the closed environment, the paper plates are passed sequentially into a coating area, which is shown in FIG. 1 with two oppositely-directed nozzles 23. Each of the nozzles directs a wave of liquid coating onto the surface of the paper plates to provide a great excess of liquid coating on the surface. At this point, the coating, having been applied in excess, freely drips from the plate surface, which has been thoroughly drenched over its entire surface area with the liquid coating.

FIG. 2 shows an enlarged view of the liquid coating being applied as a wave (only one nozzle being shown) to the food-contacting surface of a paper plate. As shown, the paper plate is carried upside-down on the conveyer belt through the coating wave to apply the coating to the food contacting surface. When the paper plate is held as shown, the liquid coating, delivered from the nozzles, can be generously applied to the entire food-contacting surface of the plate, including the rim and the outermost edge of the rim. Excess liquid coating can drip back into the reservoir 24 from the surface.

While a conveyer having orifice openings to hold paper plates is illustrated, it is possible to deliver articles for coating using delivery means other than a conveyer belt.

After coating, the conveyer carries the plates into the coating removal zone of the closed environment. A series of air knives are shown at 25, which direct a flow of air sufficient to evenly spread the applied liquid coating and remove excess coating, which is collected below the air knives, and optionally stored in elevated reservoir 14 prior to reuse. The conveyer can be cleaned off by secondary air knives 25*a*, which also takes place inside closed environment 20. A divider 26 can keep the reservoir of coating below the nozzles separate from the collection of coating below the air knives. The number of air knives needed to remove the coating is not critical, and can depend on processing speed, type of coating, and other factors within the skill of the ordinary artisan.

After removal of the coating by the air knives, the conveyer passes the plates out of the closed environment and into the outlet station 40. A preferred outlet system is described in connection with FIG. 1. As shown, the plates are transferred from the conveyer belt 21 to second conveyer belt 41, in the same upside-down orientation. Shown at 42 is an air plenum, which directs air outwardly against the plates and holds them firmly against the second conveyer 41 at a distance from the air plenum. Thus, nothing but air contacts the freshly-coated surface when the plates exit the closed environment. The air flow from the plenum also starts to dry the coating on the surface of the plates. The plates are carried by the second conveyer 41 in a direction around and below the air plenum, as shown. At the end of the second conveyer, the plates (now upright in orientation, with the coated surface facing upwardly) are deposited onto removal conveyer 43 to be carried to a drying station (not shown).

Figure 3:
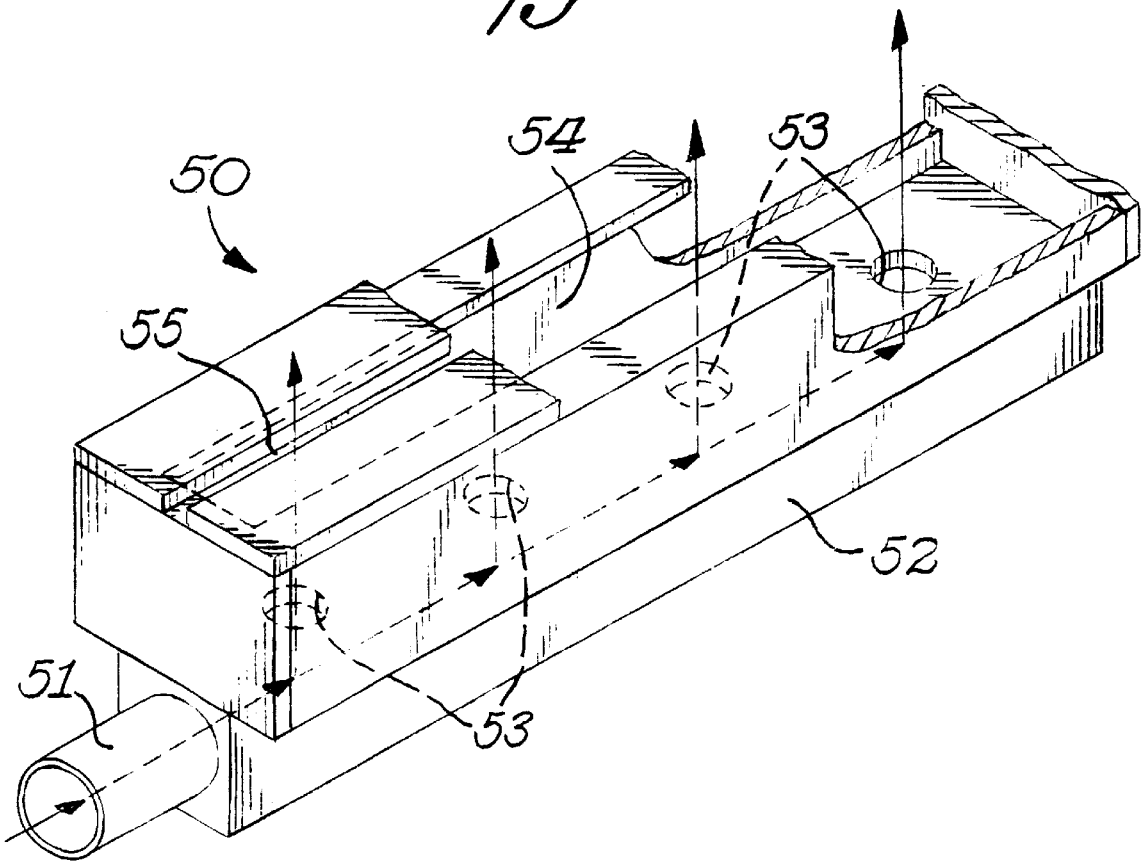
FIG. 3 is a partial cut-away view of one type of slotted nozzle suitable for generating a wave of liquid coating material.

FIG. 3 shows a preferred form of nozzle structure 50. The structure includes a coating material inlet 51. Inlet 51 supplies holding chamber 52, wherein the coating pressure builds as liquid coating fills the chamber. Chamber outlets 53 release pressurized liquid coating from holding chamber 51 into wave chamber 54. Wave chamber 54 holds the liquid coating under pressure, and the pressure forces the coating out of the nozzle through long, thin slot 55 to create the wave of liquid coating. The size of the wave can be controlled by adjustment of the pressure inside the nozzle or by adjusting the height of elevated reservoir 14 which can supply the coating to the nozzles.

In the coating process, the amount of coating applied to the surface of the article normally depends on the intended use. The process described herein provides a smooth uniform coat using a small amount of coating. In a currently preferred embodiment, about 0.3 to 5 grams of coating (as solids) is applied to one full surface of an average sized (10 to 11" diameter) molded fiber plate. Using the disclosed system, 10.5" plates can be coated at a rate of about 5 plates per second.

While the invention has been described in terms of preferred embodiments, other embodiments will be apparent to those skilled in the art.

What is claimed is:

1. A process for coating a surface of a contoured molded pulp article with a liquid coating, which comprises passing the surface into contact with at least one wave of liquid coating to apply an excess of coating to the surface, and thereafter spreading the coating and removing the excess coating from the surface, wherein the liquid coating comprises a vehicle and the coating application and removal of excess coating are carried out in a closed environment in which an atmosphere vaporous with the vehicle of the coating is maintained, the vaporous atmosphere being maintained such that essentially no drying of the liquid coating takes place on the article surface in the closed environment.

2. The process of claim 1, wherein the liquid coating is an aqueous dispersion or solution of plastic, resin or polymer.

3. The process of claim 2, wherein the liquid coating is a dispersion of styrene-butadiene.

4. The process of claim 2, wherein the process is carried out in an atmosphere vaporous with water vapor.

5. The process of claim 1, wherein the wave is created by a nozzle positioned below the article to be coated.

6. The process of claim 5, wherein the coating is applied to the surface by more than one wave, with the waves being applied to the surface from different directions.

7. The process of claim 1, wherein the excess liquid coating is removed with one or more air knives.

8. The process of claim 7, wherein the air knives deliver air vaporous with the coating vehicle.

9. The process of claim 1, wherein the article is a molded pulp paper plate, tray or bowl.

10. The process of claim 1, further comprising drying the article.

11. The process of claim 1, wherein the liquid coating is recycled.

12. The process of claim 1, wherein the articles are molded pulp plates, and are coated at a rate of about 5 plates/second.

13. A process for coating a surface of a contoured, molded pulp article with a liquid coating, comprising contacting the surface with an excess of liquid coating comprising a plastic, resin or polymer provided in a vehicle, and removing the excess coating from the surface by at least one air knife, the process being carried out in a closed environment in which an atmosphere vaporous with the coating vehicle is maintained.

14. The process of claim 13, wherein the coating is an aqueous dispersion or solution.

15. The process of claim 14, wherein the liquid coating is a dispersion of styrene-butadiene.

16. The process of claim 13, wherein the coating is applied as at least one wave.

17. The process of claim 13, wherein the article is a molded pulp paper plate, bowl or tray.

18. The process of claim 13, further comprising drying the article.

19. The process of claim 13, wherein the articles are molded pulp plates, and are coated at a rate of about 5 plates/second.

* * * * *